US007402092B1

(12) United States Patent
Randall et al.

(10) Patent No.: US 7,402,092 B1
(45) Date of Patent: Jul. 22, 2008

(54) DRINKING CUP

(76) Inventors: Gary Randall, 2605 Denali St. #204, Anchorage, AK (US) 99503; Don Karterman, 675 Birch, Anchorage, AK (US) 99501

( * ) Notice: Subject to any disclaimer, the term of this patent is extended or adjusted under 35 U.S.C. 154(b) by 457 days.

(21) Appl. No.: 11/099,366

(22) Filed: Apr. 4, 2005

(51) Int. Cl.
*A47G 19/22* (2006.01)

(52) U.S. Cl. ..... 446/74; 446/176; 446/267; 220/705

(58) Field of Classification Search ..... 446/74, 446/176, 177, 217, 267, 483, 201; 220/705–709, 220/521; 239/33
See application file for complete search history.

(56) References Cited

U.S. PATENT DOCUMENTS 2,544,594 A * 3/1951 Goldfarb ..... 446/74
5,337,918 A * 8/1994 Wang ..... 220/708
5,848,721 A * 12/1998 Cornell et al. ..... 220/706
6,276,559 B1 * 8/2001 DeMars ..... 220/707
6,629,624 B2 * 10/2003 Stillinger et al. ..... 220/714
2006/0138153 A1 * 6/2006 Chen ..... 220/705

* cited by examiner

*Primary Examiner*—Kien T Nguyen
(74) *Attorney, Agent, or Firm*—Michael J. Tavella

(57) ABSTRACT

A drinking cup that has a removable lid with three different types of drink delivery novelties. The first is a rotary drive dispenser. In which fluid is drawn up in a straw. At the top of the straw is a rotary arm, which is free to rotate. As the fluid is brought up through the straw, it is forced out of holes formed in the rotary arm causing the arm spins around the straw. As it rotates, the fluid is dispensed into a sump where a drinking straw is used to remove it. In the second design, fluid rises up through the straw where it exits the straw like a fountain spray. In the third design, a tall tube extends up from the lid. A ball sits in the tube. As the fluid is brought up, the ball is propelled upward inside the tube.

8 Claims, 13 Drawing Sheets

DRINKING CUP

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to novelty drinking cups and particularly to novelty drinking cups having rotating elements.

2. Description of the Prior Art

Many drinking cups that have novelty displays to attract children have been developed over the years. Novelty straws have also been designed.

BRIEF DESCRIPTION OF THE INVENTION

The instant invention is a drinking cup that has a removable lid. He lid had three different types of drink delivery novelties. The first is a rotary drive dispenser that can be either fluid or air driven. In this design, fluid in the lower cup is drawn up in a straw. At the top of the straw is a rotary arm. The arm is attached to the straw so that it is free to rotate. As the fluid is brought up through the straw, it is forced out of holes formed in the rotary arm. The holes are oppositely disposed so that as the fluid leaves the rotary arm, the arm spins around the straw. As it rotates, the fluid is dispensed into a sump where a drinking straw is used to remove it for drinking.

The second embodiment does not have a rotary arm. In this design, the fluid rises up through the straw where it exits the straw like a fountain spray. The top of the lid is curved so that as the spray of fluid strikes the lid, it is dispersed down the sides of the lid into a sump, where it can be removed for drinking.

The third design has a tall tube extending up from the lid. A ball sits in the tube. As the fluid is brought up, it causes the ball to be propelled upward inside the tube. A release valve is placed in the top of the tube to release the suction from the ball when it reaches the top of the tube.

DETAILED DESCRIPTION OF THE INVENTION

Figure 1:
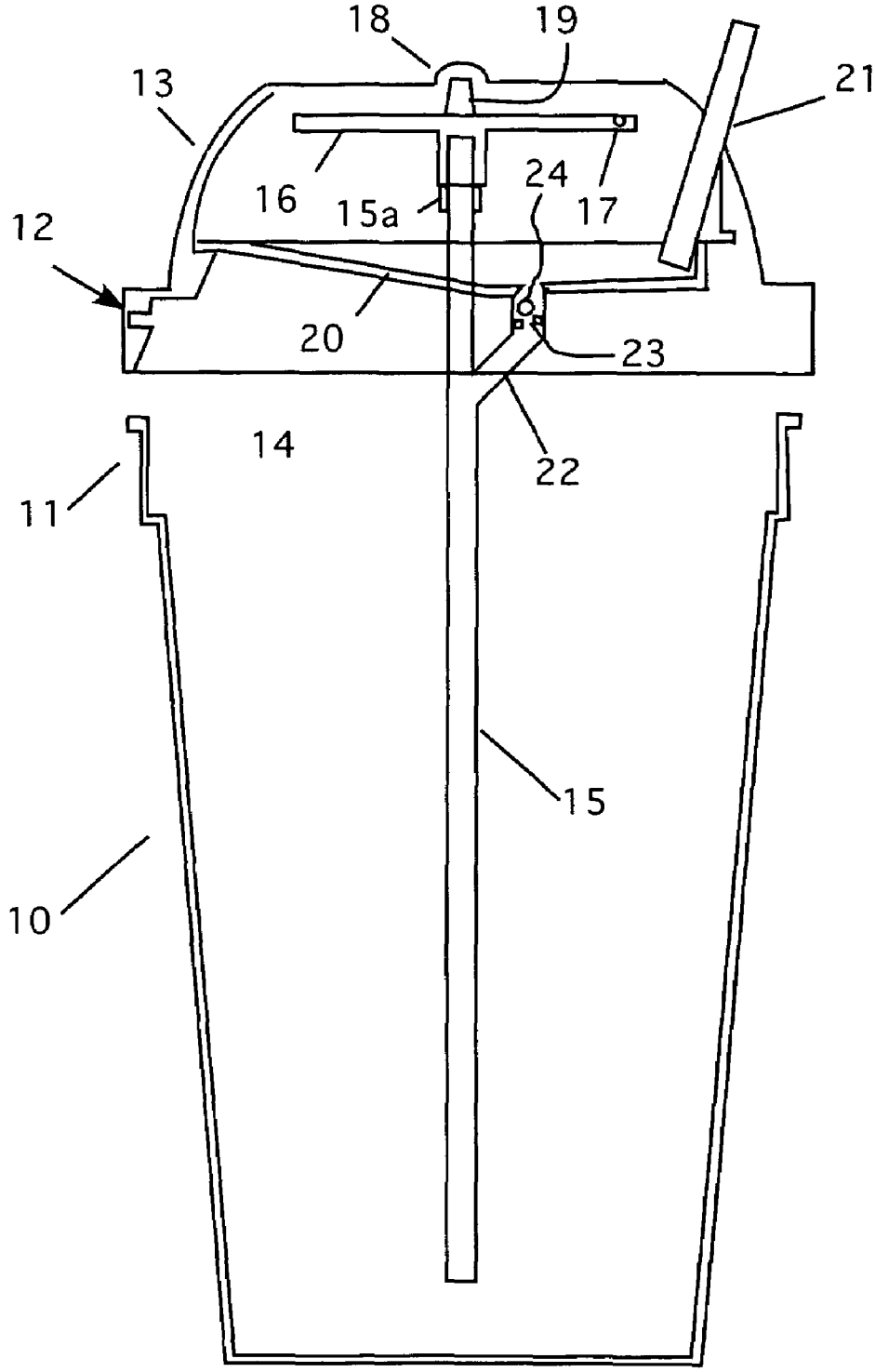
FIG. 1 is a partially sectioned side view of the first embodiment of the invention showing the fluid drive rotary arm.

FIG. 1 shows a partially sectioned side view of a fluid drive rotary arm cup lid. In this embodiment, a rotary arm turns in the lid when the fluid in the cup is drawn out through a straw. FIG. 1 shows a cup 10 that has an elongated hollow body. The top of the cup 10 has a formed lip 11 that seals the lid 12 to the cup 10.

The lid 12 has a number of components. The lid 12 has a shell 13 that has a lower lid 14 that mates with the lip 11 on the cup. The two lips, when mated, make an airtight seal. A sump straw 15 extends down from the lid to the bottom of the cup a shown. The sump straw 15 has an open top. A rotor arm 16 is placed on the open top of the sump straw as shown. The rotor arms rests on a ridge 15*a* formed on the sump straw. The rotor arm 16 rests on the ridge when the device is not in use. Because the rotor rides up on a cushion of air or fluid, there is very little friction affecting the rotor. Because of this, when the device is used as a game spinner, the ridge 15*a* acts as a "brake" to slow the rotor down after the user has stopped drinking. Once the drinking is stopped, the rotor descends and contacts the ridge, where the increased friction stops the rotation after a few seconds. Otherwise, the rotor could turn for several minutes, which would severely affect the ability to play a game.

Figure 3:
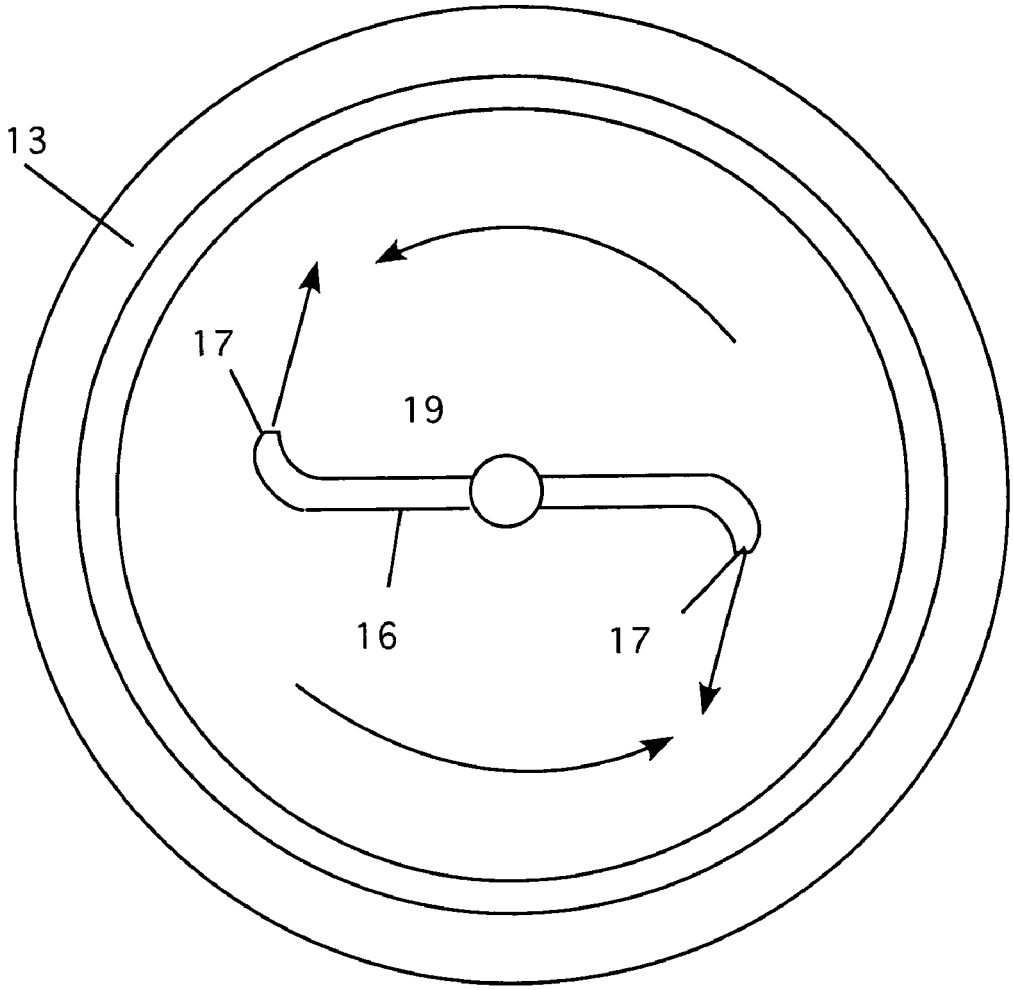
FIG. 3 is a top plan view of the rotary arm showing the arm turning and the fluid or air being dispersed.

The rotor arm 16 has to outlet ports 17 (see also FIG. 3). The shell 13 of the lid 12 has a bulge 18 at the top as shown. A point bearing 19, formed on the top of the rotor arm 16 sits in the bulge 18 as shown. The point bearing allows the rotor arm to spin freely in the lid. The bulge and point bearing also keep the rotor arm in place on the top of the sump straw when fluid is extracted.

As fluid is drawn up from the cup, it is passed through the rotor arm, where it exits through the outlet ports 17. As it does so, the rotor arm spins around (see FIG. 3). The fluid that leaves the rotor arm is collected in a sump 20 formed in the bottom of the lid. A straw 21 is used to draw the collected fluid from the sump so that a user can drink the liquid. A return arm 22 is formed on the sump straw as shown. Ball valve 23 is used to control the escape of fluid from the sump back into the cup. The ball 23 is retained by narrow openings formed above and below the ball. Thus, when the user sucks on the straw 21, fluid is drawn up through the sump straw. The ball 23 is also drawn up to seal the opening 24. The fluid is dispersed into the lid and collected in the sump for drinking. As long as suction is applied to the straw 21, the fluid is delivered to the user through the sump. As soon as the suction is removed, the rotor arm stops and the ball 24 drops. This allows any remaining fluid to drop back into the cup through the return arm 22.

In practice, the vacuum formed when drinking is not relieved until the fluid flows back down out of the straw 21. Thus, during the time between the last drink and the vacuum is released, a small portion of the fluid keeps flowing into the rotor housing chamber reservoir until the fluid level reaches the sump line outlet. A finger hole 25 helps to maintain a vacuum while drinking. When drinking, the user covers this hole. Once the user has finished drinking, the user removes his or her finger, which allows ambient atmosphere into the chamber. This allows the user to drink any overflow from the sump without causing more fluid to be drawn up into the chamber.

Figure 2:
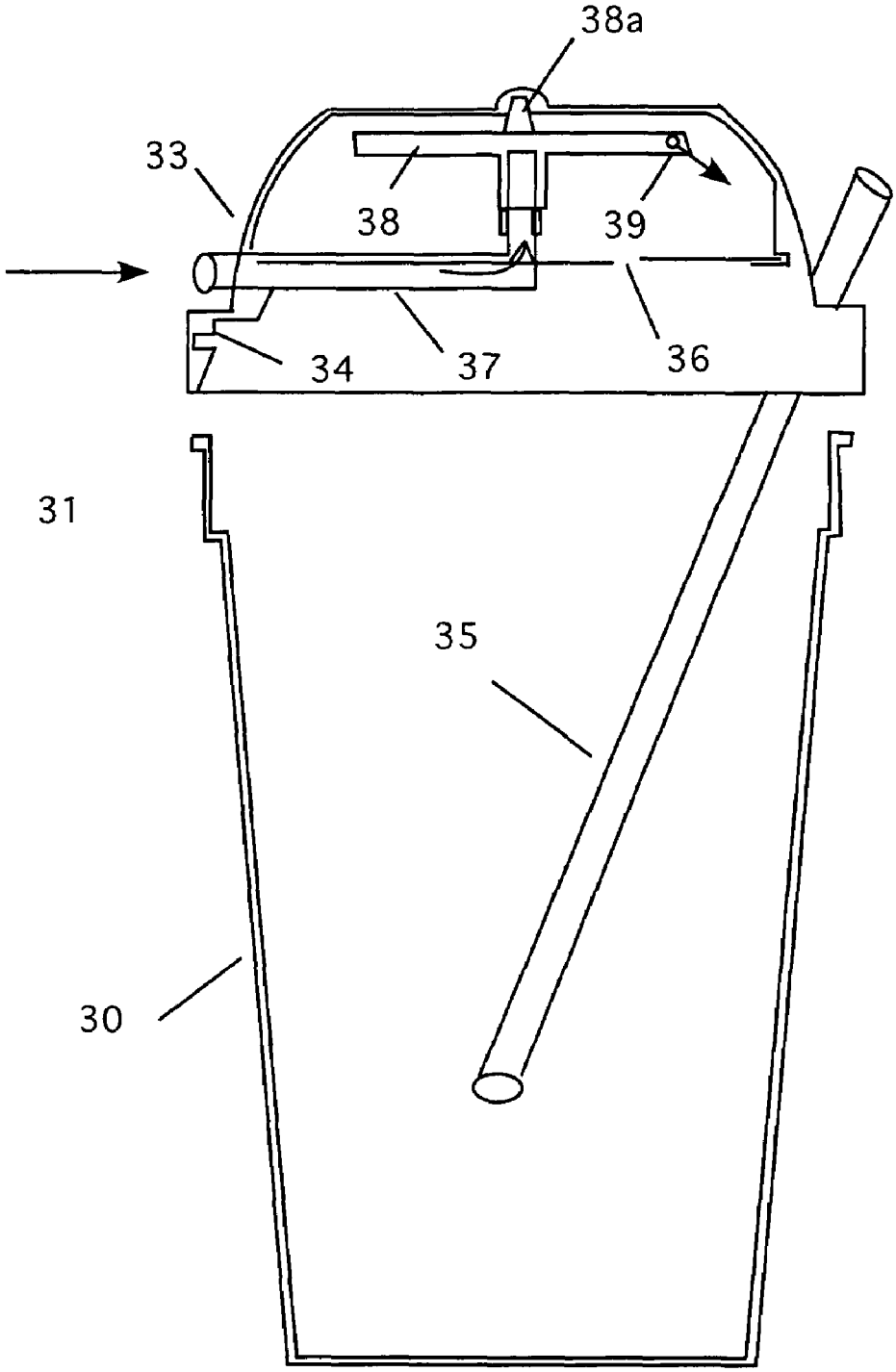
FIG. 2 is a partially sectioned side view of the second embodiment of the invention showing the air drive rotary arm.

FIG. 2 shows a second embodiment. In this design, the rotor arm is tuned by differential air pressure rather than liquid flow. Here, the device has a cup 30. As before, the cup has an upper lip 31. The lid 33 has a corresponding low lip 34 that mates with the lip on the cup. A straw 35 passes through the lid, through an airtight opening, into the cup. The lid has an air exit hole 36 that allows air to pass from the lid into the cup. An air-inlet tube 37 extends from outside of the lid into the lid as shown. The tube bends up to support the rotor arm 38, which has outlet holes 30 as before. The rotor arm is secured with the point bearing 35 as in the case of the first design. Unlike the first design, the rotor is not turned by liquid. It is turned by air. As the user sucks on the straw, the user pulls liquid up through the straw. As this happens, air is pulled from the lid down into the cup through the air exit hole 36. This creates a partial vacuum, which then causes air to enter the air-inlet tube 37. Air then passes up through the rotor arm 38 where it exits the outlet holes 39, causing the rotor arm to spin. In this design, fluid does not enter the lid at all.

FIG. 3 shows a top view of a lid showing the rotor arm applicable to either of the two embodiments discussed above. Here, the outlet ports 17 are shown with fluid exiting (the straight arrows), which causes the rotor arm to turn in the direction of the curved arrows. Note that although the numbers are for the liquid-driven rotor arm, the structure of the rotor arm is the same for the air-driven design.

Figure 3A:
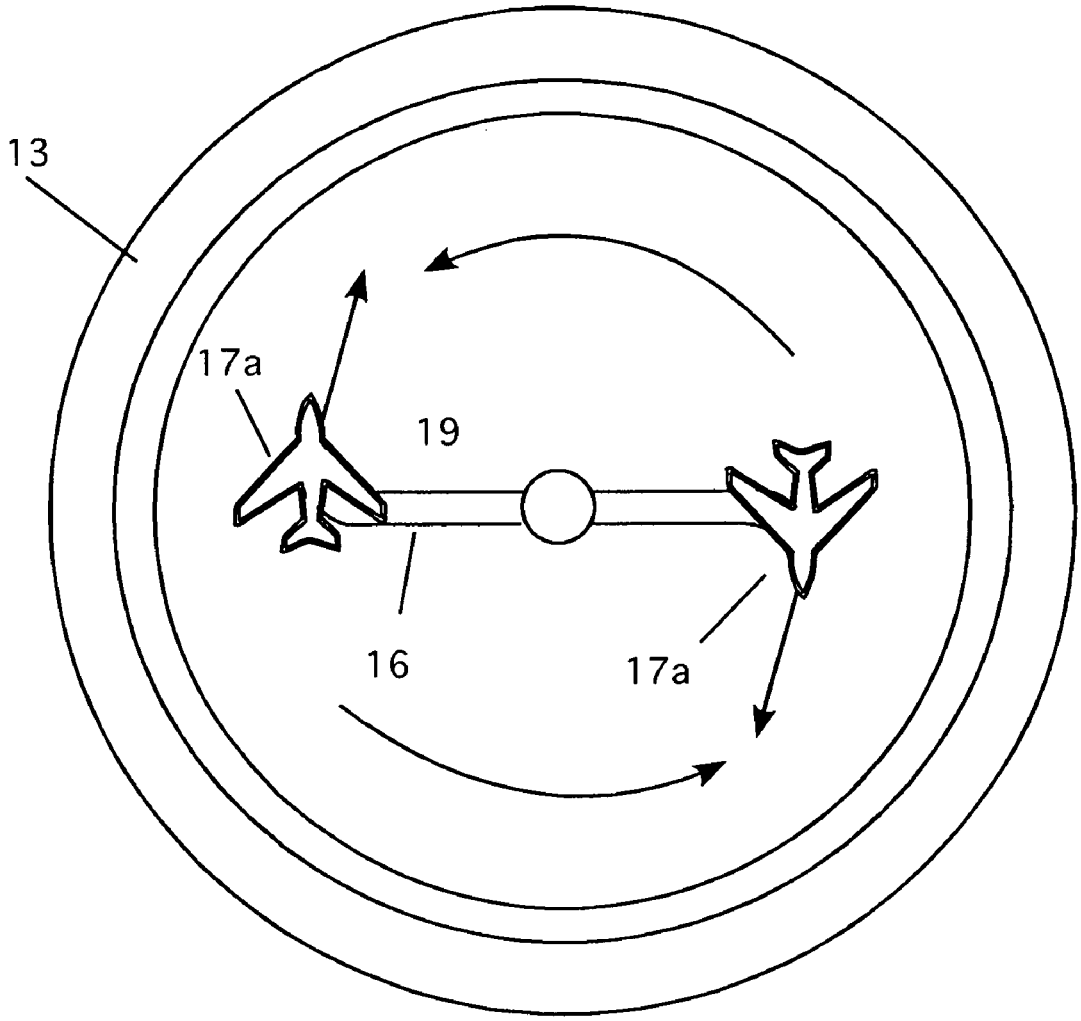
FIG. 3*a* is a top plan view of the rotary arm showing the arm with small jet planes attaches to the rotor.

FIG. 3*a* is a top plan view of the rotary arm showing the arm with small jet planes attaches to the rotor. Here, the rotor 16 and hub 19 are shown as before. However, two small jet plane forms 17*a* have been attached to the rotor 16 as shown. The jet plane figures add interest to the rotor for the amusement of the user. Of course, any other similar type of form can be added to the rotors as desired.

Figure 3B:
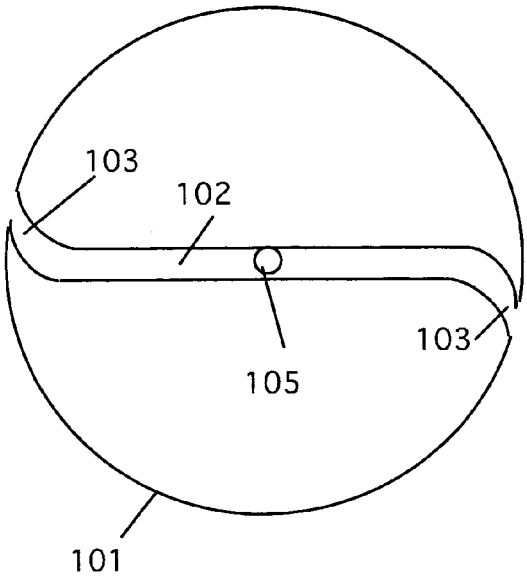
FIG. 3*b* is a top view of a rotor disk that is an alternative to the rotor arm of FIG. 3.

FIG. 3*b* is a top view of a rotor disk that is an alternative to the rotor arm of FIG. 3. In this embodiment, the rotor is replaced by a pair of disks. FIG. 3*b* shows the lower disk 101 that has a channel 102 formed in it as shown. The channel is angled at the ends for form two pullets 104. An opening 105 in the base of the disk allows the fluid to enter the channel so that it can be propelled by the disk as it rotates.

Figure 3C:
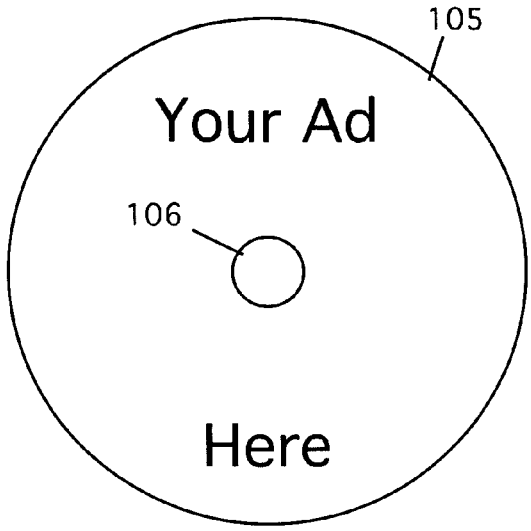
FIG. 3*c* is a top view of a cover disk that is an alternative to the rotor arm that shows an advertising message printed on the cover disk.

FIG. 3*c* is a top view of a cover disk 105 that shows an advertising message 106 printed on the cover disk. The point bearing 106 is shown in the center of the cover disk. Note that the message can be of any form and any message desired.

Figure 3D:
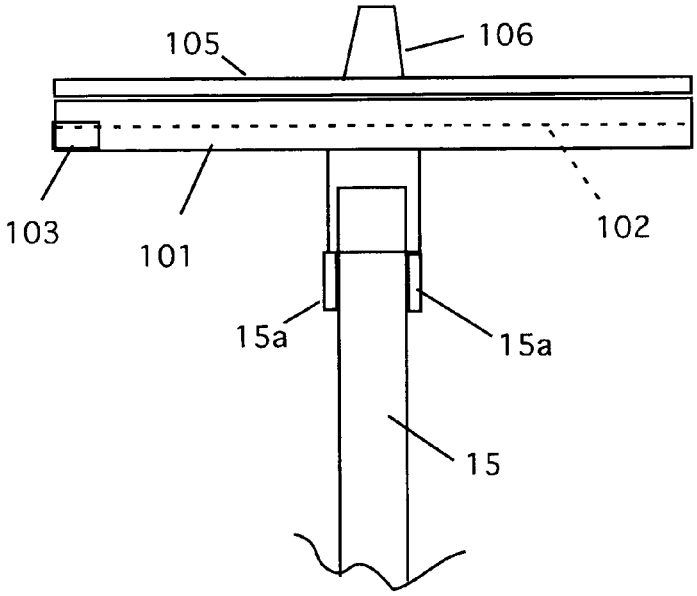
FIG. 3*d* is a side view of the alternative rotor disk assembled for use.

FIG. 3*d* is a side view of the alternative rotor disk assembled for use. Here, the sump straw 15 and the ridge 15*a* are shown. The alternative rotor is shown in place on the sump straw 15, ready for use.

Figure 4:
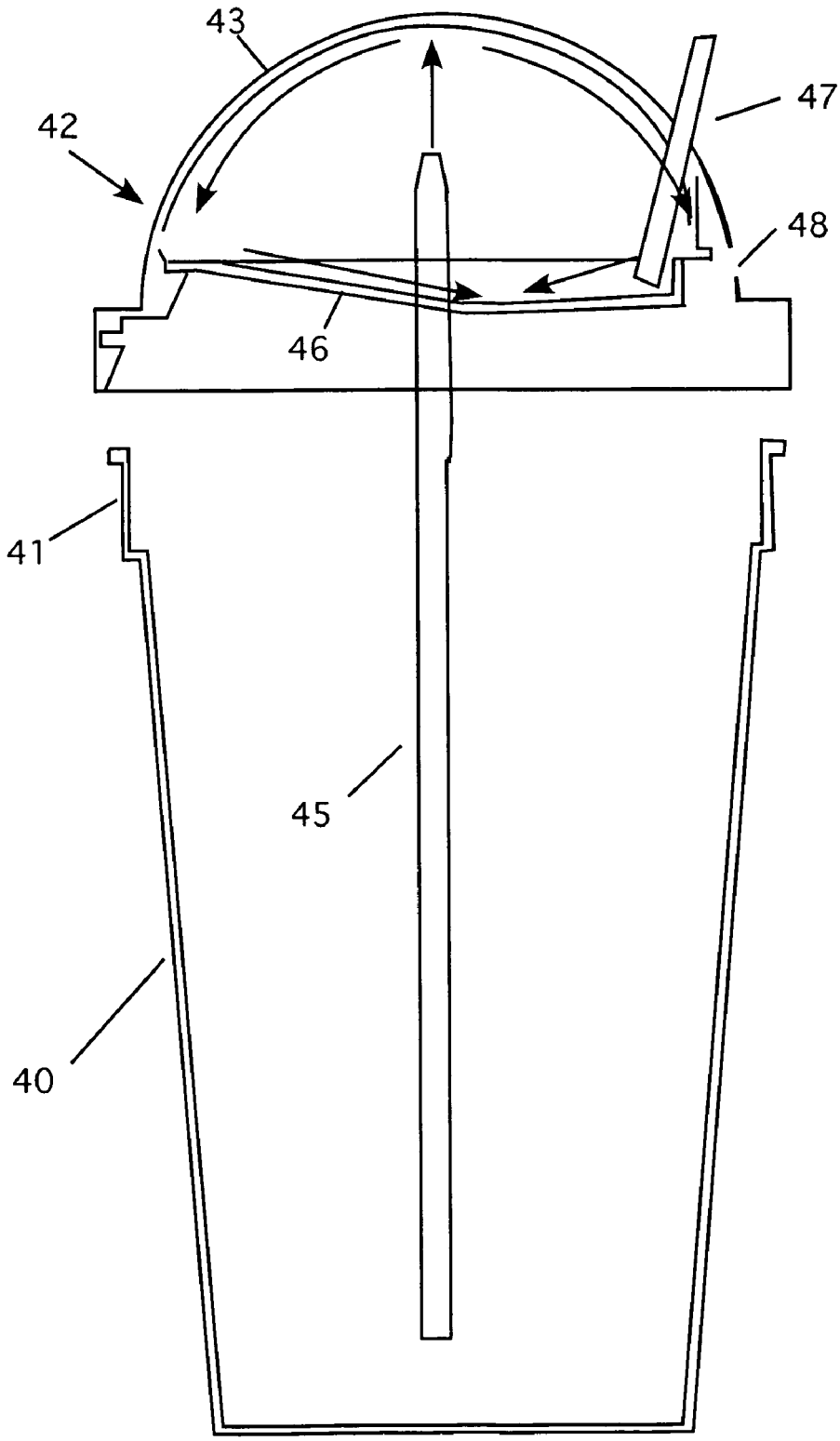
FIG. 4 is a partially sectioned side view of the third embodiment of the invention showing the fluid fountain effect.

FIG. 4 is a partially sectioned side view of the third embodiment of the invention. In this embodiment, there is a lower cup 40 having a top lip 41, which is generally identical to that of the first embodiment. This embodiment has a lid 42. The lid 42 has a shell 43 and a lower lid 44, which mates with the lip 41 on the cup. The two lips, when mated, make an airtight seal. In this embodiment, the shell 43 is generally curved and smooth, forming a semispherical surface.

A sump straw 45 extends down from the lid to the bottom of the cup a shown. The sump straw 45 has an open top. Unlike the first embodiment, this embodiment has no rotor arm. As fluid is drawn up from the cup (indicated by the arrows on the figure), it is discharged upward from the top of the sump straw 45. As it does so, it strikes the curved shell, producing a fountain effect. The fluid drains down over the curved surface where it is collected in a sump 46 formed in the bottom of the lid. This sump differs from the embodiment of FIG. 1. Here, as before, straw 47 is used to draw the collected fluid from the sump so that a user can drink the liquid. However, there is no return arm formed on the sump straw, or ball valve used to control the escape of fluid from the sump back into the cup. As the user sucks on the straw 47, fluid is drawn up through the sump straw. The fluid is dispersed into the lid and collected in the sump for drinking. As long as suction is applied to the straw 47, the fluid is delivered to the user through the sump. Unlike the embodiment of FIG. 1, a finger hole 48 is provided to allow the remaining fluid to be removed from the sump without causing more fluid to rise into the lid (without the finger hole, fluid continues to enter into the sump from the sump straw and cannot be completely drained. The finger hole 48 provides a release mechanism that allows the excess fluid to be drained from the sump by drinking it through the straw 47.

Note that either the ball valve system shown in FIG. 1 or the finger hole can be used to drain the sump. They are interchangeable and it is understood that any of the embodiments shown herein can have either the ball valve or the finger hole, as desired.

Figure 5:
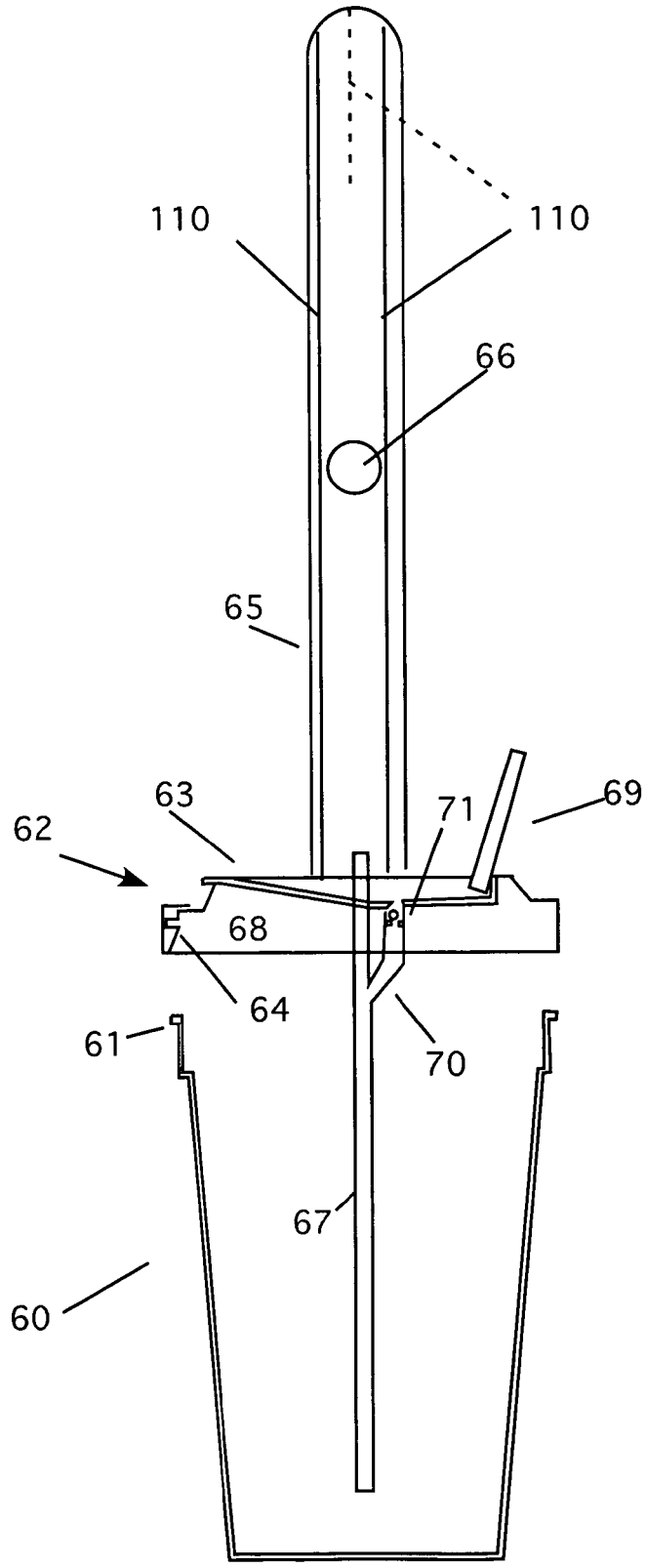
FIG. 5 is a partially sectioned side view of the fourth embodiment of the invention showing the fluid drive ball tube.

FIG. 5 is a partially sectioned side view of the fourth embodiment of the invention. In this embodiment, there is a lower cup 60 having a top lip 61, which is generally identical to that of the first embodiment. This embodiment has a lid 62 that has a shell 63 that has a lower lid 64 that mates with the lip 61 on the cup. The two lips, when mated, make an airtight seal. In this embodiment, the shell 64 is generally flat with an elongated tube 65 extending upwards from the lid as shown. A ball 66 is positioned in the tube as shown. The ball is free to move up and down within the tube.

A sump straw 67 extends down from the lid to the bottom of the cup a shown. The sump straw 67 has an open top. Unlike the first embodiment, this embodiment has no rotor arm. Rather, as fluid is drawn up from the cup, it is discharged upward from the top of the sump straw 67. As it does so, it strikes the ball 66, which causes the ball to rise in the tube as it floats on the fluid stream. As the fluid leaves the sump straw, it drains down from the tube and is collected in a sump 68 formed in the bottom of the lid. This sump and related components are identical to the embodiment of FIGS. 1 and 4. A straw 69 is used to draw the collected fluid from the sump so that a user can drink the liquid. A return arm 70 is formed on the sump straw as shown. A ball valve 71 is used to control the escape of fluid from the sump back into the cup. A ball 72 is retained by narrow openings formed above and below the ball. Thus, as the user sucks on the straw 69, fluid is drawn up through the sump straw. The ball 72 is also drawn up to seal the opening 73. The fluid is dispersed into the lid and collected in the sump for drinking. As long as suction is applied to the straw 69, the fluid is delivered to the user through the sump. As soon as the suction is removed, ball 72 drops. This allows any remaining fluid to drop back into the cup through the return arm 70. As noted above, this system can be replaced with a finger hole shown in FIG. 4, if desired.

FIG. 5 also shows a number of guides 110 that are positioned in the tube 65. The guides hold the ball 66 in the center of the tube and ensure that it rises and falls smoothly within the tube.

Figure 5A:
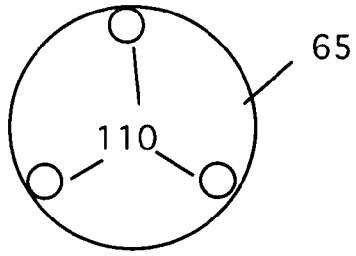
FIG. 5*a* is a top section view, taken along the lines 5*a*-5*a* of FIG. 5, showing the guides inserted in the upper tube.
Figure 5B:
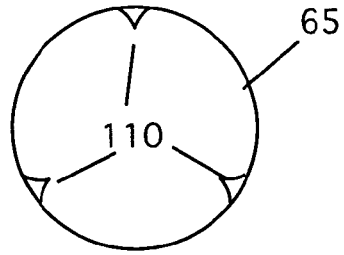
FIG. 5*b* is a top section view, taken along the lines 5*b*-5*b* of FIG. 5, showing an alternative guide construction formed in the upper tube.

FIG. 5*a* is a top section view, taken along the lines 5*a*-5*a* of FIG. 5, showing the guides 110 inserted in the upper tube 65. FIG. 5*a* shows the guides 110 as being round rods. FIG. 5*b* is a top section view, taken along the lines 5*b*-5*b* of FIG. 5, showing an alternative guide construction formed in the upper tube. Here, the guides 110*a* are shaped members that either are attached to the interior of tube 65 or are formed when the tube is made. These guides 110*a* operate in the same manner as the rods of FIG. 5*a*.

Figure 5C:
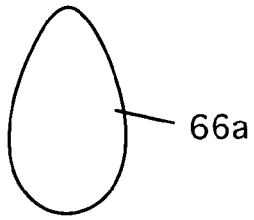
FIG. 5*c* is a side view of an alternative device for the ball shown in FIG. 5.
Figure 5D:
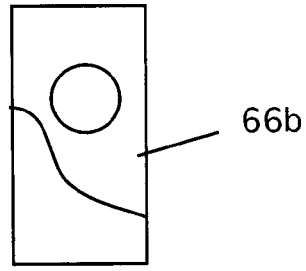
FIG. 5*d* is a can-shaped structure as an alternative device for the ball shown in FIG. 5.
Figure 5E:
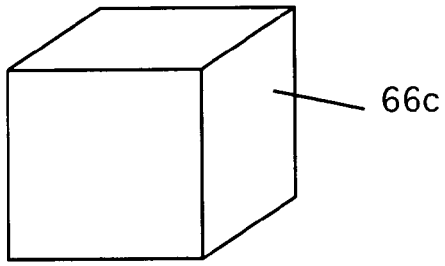
FIG. 5*e* is a cube structure as an alternative device for the ball shown in FIG. 5.
Figure 5F:
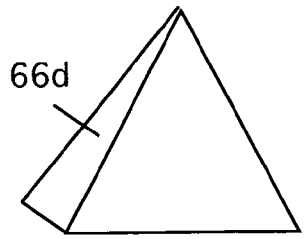
FIG. 5*f* is a pyramid structure as an alternative device for the ball shown in FIG. 5.

FIG. 5 shows the ball 66 as being an ordinary round ball. However, the ball 66 need not be so limited. For example, FIG. 5*c* is a side view of an alternative device for the ball. Here, the ball is replaced by an egg-shaped body 66*a*. FIG. 5*d* is a can-shaped structure 66*b* as an alternative device for the ball shown in FIG. 5. The can shaped structure can be decorated or covered with advertising logos (e.g., COKE or PEPSI logos can be printed on it). FIG. 5*e* is a cube structure 66*c* as an alternative device for the ball shown in FIG. 5. Finally, FIG. 5*f* is a pyramid structure 66*d* as an alternative device for the ball. Note that all of these can be decorated or imprinted with symbols, or logos. Moreover, these devices are not limited to those shown.

Figure 6:
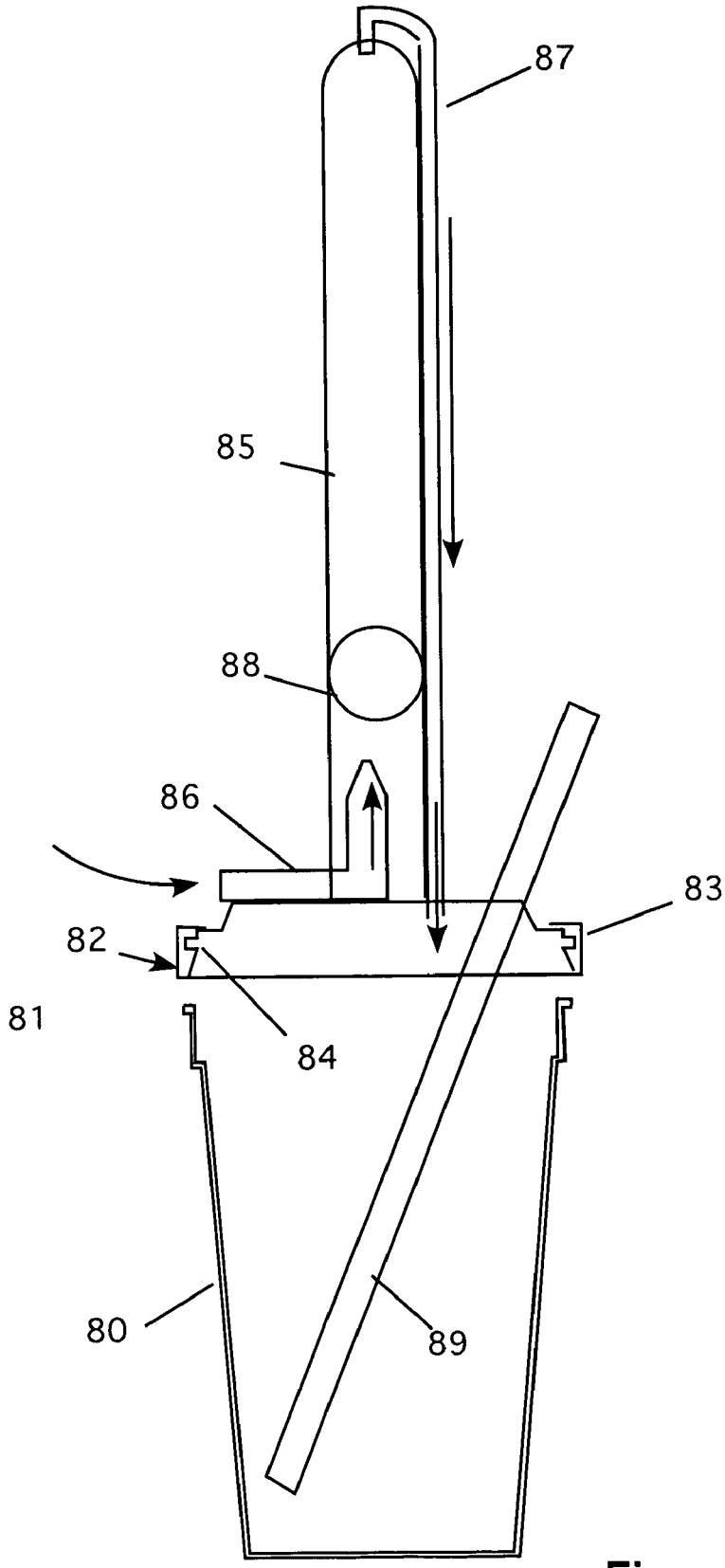
FIG. 6 is a partially sectioned side view of the fifth embodiment of the invention showing the air drive ball tube.

FIG. 6 is a fifth embodiment. In this embodiment, the ball 88 is air driven instead of fluid driven. In this embodiment, there is a lower cup 80 having a top lip 81, which is generally identical to that of the first embodiment. This embodiment has a lid 82 that has a shell 83 that has a lower lid 84 that mates with the lip 81 on the cup. The two lips, when mated, make an airtight seal. In this embodiment, the shell 83 is generally flat with an elongated tube 85 extending upwards from the lid as shown. Unlike the previous embodiment, there is no sump straw. The tube 85 is seated to the top of the lid. The lid has an air inlet tube 86 attached, which penetrates into the tube 85. The air inlet tube 86 bends upward inside the tube 85 as shown. An air outlet tube 87 is attached to the top of the tube 86. The air outlet tube 87 extends down to the lid, where it penetrates into the lid. A ball 88 is positioned in the tube as shown. The ball is free to move up and down within the tube. Again, a finger hole 73 is provided to allow the remaining fluid to be removed from the sump without causing more fluid to rise into the lid.

A straw 89 passes through the lid and extends down into the cup. As the user drinks from the cup, fluid is pulled from the cup through the straw. This causes a partial vacuum in the tube, which causes the ball 88 to be propelled upward. The air inlet tube allows replacement air to be pulled into tube. Air then passes from the tube 85 into the air outlet tube 87, where it then enters the cup through the lid.

Figure 7:
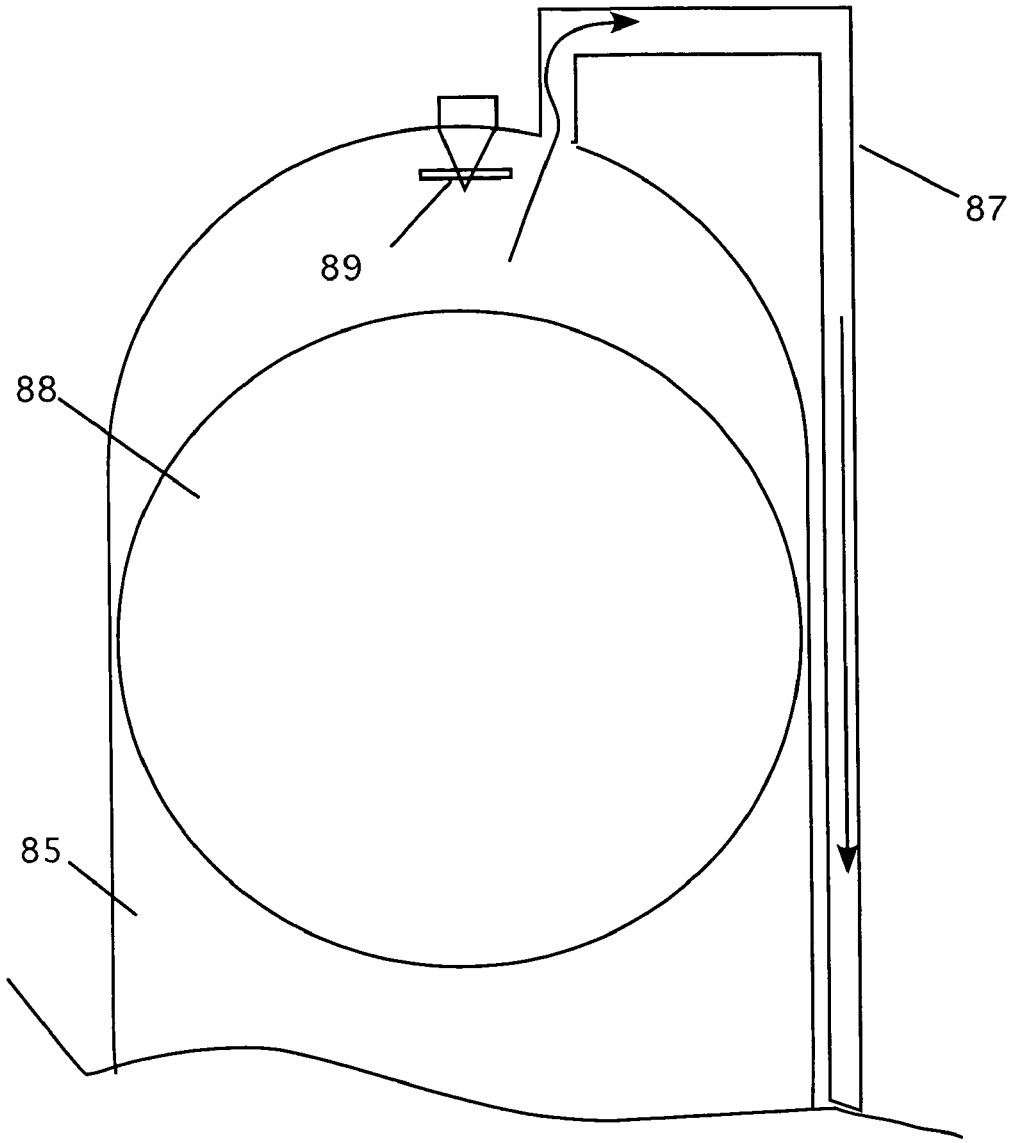
FIG. 7 is an enlarged detail view of the top of the air-drive ball tube showing the release valve mounted in the top.

FIG. 7 shows a detail of the top of the tube 85. Because the ball 88 is drawn up to the air outlet by the suction force, it can get stuck and held there. If that occurs, the device freezes up. To prevent this, a pop valve 89 is attached to the air outlet tube as shown. It the ball is drawn up to the top, it strikes the pop valve, which then opens to release the vacuum. This keeps the ball 88 from becoming stuck on the air inlet tube.

Figure 8:
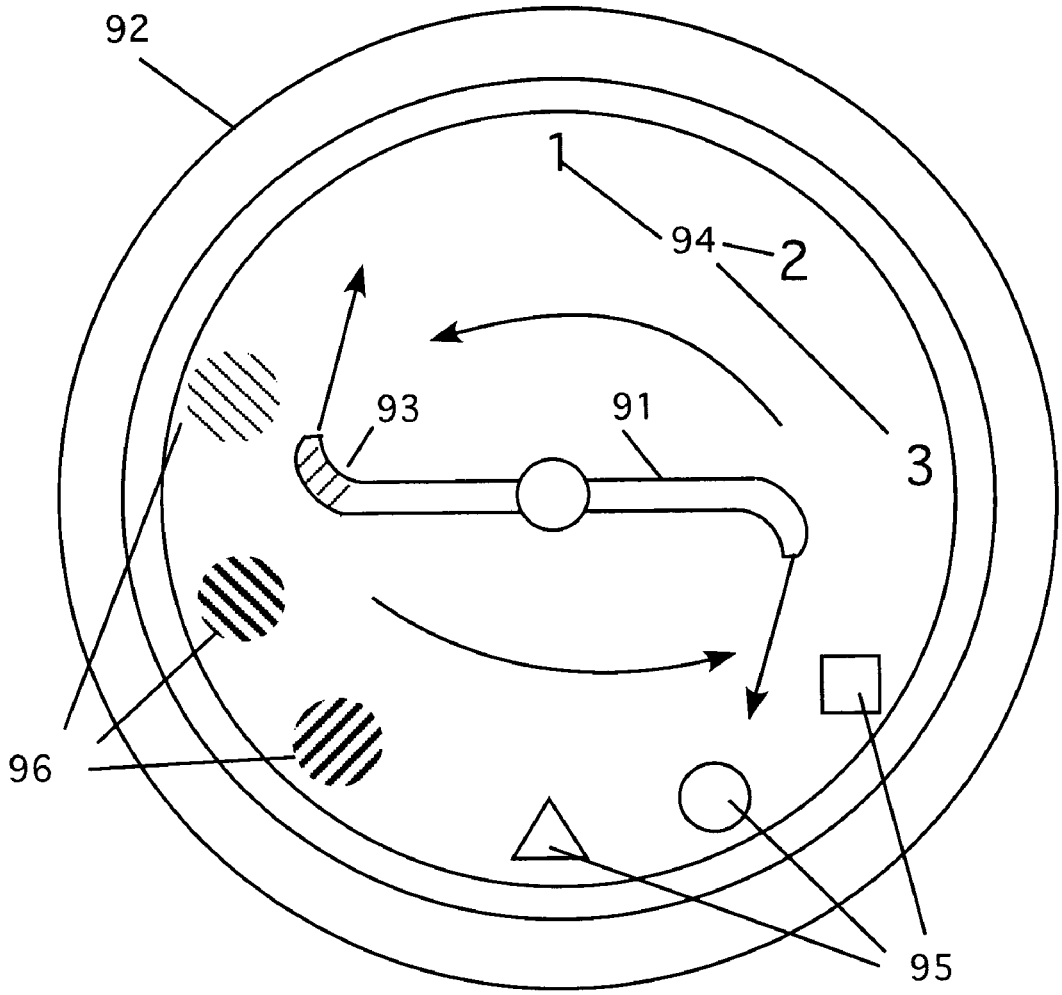
FIG. 8 is a modification for the first and second embodiments wherein the modified lid can be used as part of a game.

FIG. 8 is a top detail view of a modified lid used with the first two embodiments. Here, a rotor arm 91 is shown, positioned in a lid 92. One end 93 of the rotor arm is colored or marked to act as an indicator. A series of indicators, such as numbers 94, symbols 95 or colors 96, is positioned around the circumference of the lid as shown. As shown, all three, numbers, colors and symbols are in place on the lid. In practice, all numbers, all symbols, or all colors would be used (but need not be so limited). The lid can then be used as a game spinner. In this case, the user activates the rotor arm by taking a drink (or if the cup is empty, can simply pull air though the cup). As the fluid leaves the cup, the rotor arm spins. When the user stops drinking, the rotor arm spins for a brief time before stopping at a particular position. The marked end 93 of the rotor arm is then aligned with one of the numbers 94, indicating a number for play, e.g., indicating the number of spaces to move in a board game. Moreover, the lid can be used without having to take a drink as simply sucking on the straw causes the rotor to turn. In this way, the lid can be used in a number of games as a game spinner.

Figure 9:
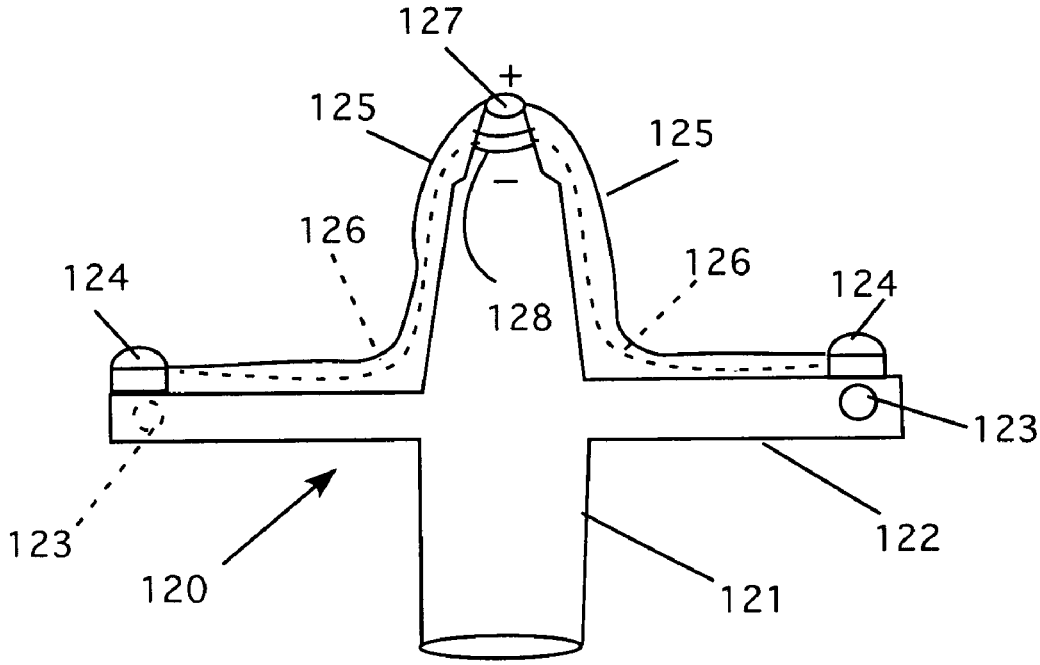
FIG. 9 is a detail view of an alternative rotor that is wired for lighting.

FIG. 9 is a detail view of an alternative rotor that is wired for lighting. In this embodiment, the rotor 120 has a lower shaft 121 that sits on the sump straw as before. Two rotor arms 122 extend out from the shaft as shown. The exit ports 123 are shown on the rotor arm (one in dashed lines on the opposite side of the rotor). The top of the rotor forms the point bearing as before, however, here, it is wired for light. A pair of low voltage led bulbs 124 are placed on the ends of the rotor arms 122 as shown. Wires 125 and 126 are run from the bulbs to electrical contacts 127 (positive) and 128 (negative) as shown. Note that the negative contact is actually a band that runs completely around the point bearing.

Figure 10:
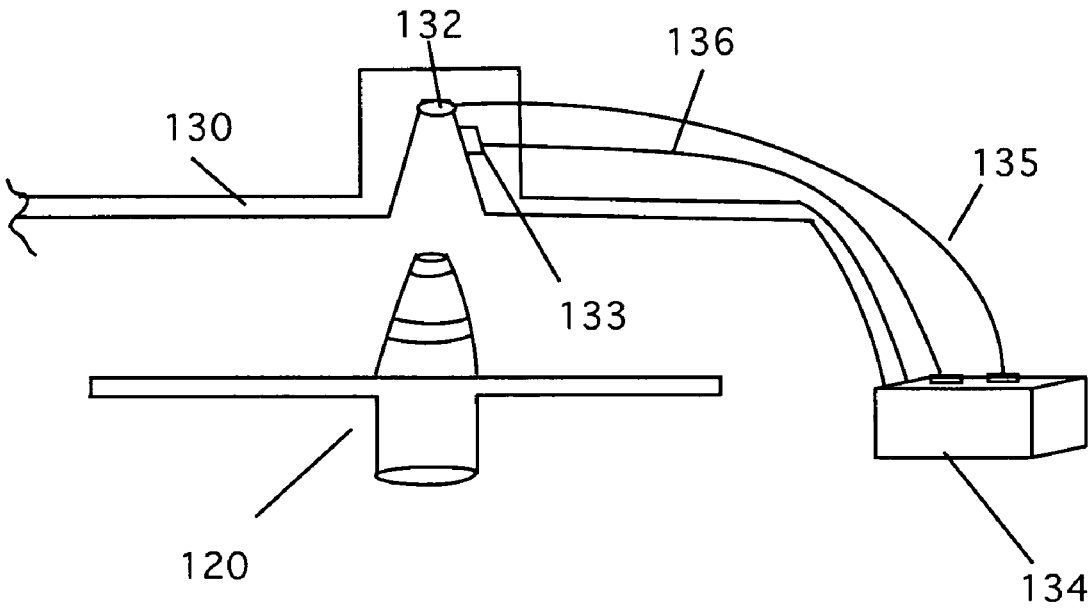
FIG. 10 is a detail of the wired rotor and the lid that attaches to a battery to provide power for the lighting in the rotor.

FIG. 10 is a detail of the wired rotor and the lid that attaches to a battery to provide power for the lighting in the rotor. Here, the rotor 120 is shown beneath the top of the lid 130. The lid 130 has a receptacle 131 for the point bearing. The receptacle has a positive terminal 132 and a negative terminal 133 that connect to a battery 134 by wires 135 and 136 as shown. When the rotor is placed in the lid and the user drinks, the rotor rises into the receptacle, where the contacts on the rotor make electrical contact with the terminals in the lid. This causes the lights to illuminate.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. An amusement drinking device for mounting on a beverage container and operable upon withdrawal of the beverage from the container comprising:

a) a cover for fitting over the open end of a beverage container in an airtight arrangement, said cover having a port for receiving a drinking straw extending therein;

b) a riser straw, extending from said cover downwardly into said beverage container, said riser straw having an open top;

c) a rotor, rotatably mounted on said riser straw in said cover, wherein said rotor having a pair of oppositely disposed arms, and further wherein each of said pair of oppositely disposed arms has an exit port formed therein;

d) said cover defining a circular trough in said exposed surface thereof, forming a sump and further wherein said drinking straw is in contact with said sump;

e) wherein when suction is applied to said drinking straw, fluid is drawn up in said riser straw, wherein said fluid exits through said exit ports in said pair of oppositely disposed arms, causing said rotor to rotate about said riser straw.

2. The amusement drinking device of claim 1 wherein fluid exiting from said rotor is collected in a sump.

3. The amusement drinking device of claim 2 further comprising:

a) a suction activated check valve, installed in said sump; and b) a return line, attached to said check valve and to said riser straw;

c) wherein when suction is removed from drinking straw, the check valve opens, thereby allowing fluid accumulated in said sum to exit said sump through said return line back into said beverage container.

4. The amusement drinking device of claim 2 wherein the sump has a perimeter and further a plurality of symbols printed about said perimeter.

5. The amusement drinking device of claim 4 wherein the plurality of symbols is selected from the group of: numbers and letters.

6. The amusement drinking device of claim 1 wherein the rotor and cover further comprise:

a) pair of low voltage led bulbs, placed on the ends of the rotor arms;

b) a positive electrical connector, attached to said rotor;

c) a negative electrical connector attached to said rotor;

d) a pair of wires, attached to said pair of bulbs and to said positive electrical connector;

e) a pair of wires, attached to said pair of bulbs and to said negative electrical connector;

f) a receptacle formed in said cover, said receptacle having a positive terminal and a negative terminal installed therein;

g) a battery attached to said cover;

h) a first wire, extending from said battery to said positive terminal in said cover; and i) a second wire, extending from said battery to said negative terminal in said cover;

j) such that when the rotor is placed in the cover and a user drinks, the rotor rises into the receptacle, such that the contacts on the rotor make electrical contact with the terminals in the lid, which causes the bulbs on said rotor to illuminate.

7. An amusement drinking device for mounting on a beverage container and operable upon withdrawal of the beverage from the container comprising:

a) a cover for fitting over the open end of a beverage container in an airtight arrangement, said cover having a port for receiving a drinking straw extending therein;

b) a riser straw, extending from said cover downwardly into said beverage container, said riser straw having an open top;

c) said cover having a circular trough therein forming a sump, and further wherein said drinking straw is in contact with said sump;

d) a suction activated check valve, installed in said sump;

e) a return line, attached to said check valve and to said riser straw;

f) wherein when suction is removed from drinking straw, the check valve opens, thereby allowing fluid accumulated in said sum to exit said sump through said return line back into said beverage container; and further g) wherein when suction is applied to said drinking straw, fluid is drawn up in said riser straw, wherein said fluid exits through said open top of said riser straw whereupon it descends into said sump.

8. The amusement drinking device of claim 7 wherein said cover forms a semispherical dome, and further wherein when said fluid exits said riser straw said fluid contacts said semispherical dome.

* * * * *